US009567961B2

(12) United States Patent
Cass et al.

(10) Patent No.: US 9,567,961 B2
(45) Date of Patent: Feb. 14, 2017

(54) ARRANGEMENT FOR RETAINING A FUEL INJECTOR TO A FUEL RAIL SOCKET

(71) Applicant: DELPHI TECHNOLOGIES, INC., Troy, MI (US)

(72) Inventors: Christopher M Cass, Fairport, NY (US); Timothy F. Coha, Canandaigua, NY (US); David A. Chinnici, Rochester, NY (US); Curis D. Lamb, West Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 32 days.

(21) Appl. No.: 14/658,431

(22) Filed: Mar. 16, 2015

(65) Prior Publication Data

US 2016/0273501 A1 Sep. 22, 2016

(51) Int. Cl.
*F02M 61/14* (2006.01)
*F02M 61/16* (2006.01)
(Continued)

(52) U.S. Cl.
CPC ..... *F02M 61/14* (2013.01); *F02M 61/16* (2013.01); *F02M 61/168* (2013.01);
(Continued)

(58) Field of Classification Search
CPC F02M 61/14; F02M 61/168; F02M 2200/856; F02M 2200/857; F02M 69/465; F02M 55/025
(Continued)

(56) References Cited

U.S. PATENT DOCUMENTS 4,993,390 A * 2/1991 Ono ..... F02M 55/004 123/456
5,970,953 A * 10/1999 Lorraine ..... F02M 69/465 123/456
(Continued)

FOREIGN PATENT DOCUMENTS

FR 2924765 A3 * 6/2009 ..... F02M 55/001
WO 9904161 A1 1/1999
(Continued)

OTHER PUBLICATIONS

Disclosed Anonymously, Unique Fuel Injector Suspension Design for High Pressure Gasoline Direct Injection, Research Disclosure, published May 2014 in paper journal, published digitally Mar. 31, 2014, Research Disclosure database No. 601008, Research Disclosure, Questel Ireland Ltd, Killernan, Kilmaine, County Mayo,Ireland.
(Continued)

*Primary Examiner* — Mahmoud Gimie
(74) *Attorney, Agent, or Firm* — Joshua M. Haines

(57) ABSTRACT

A fuel injector retention arrangement includes a fuel rail socket interior space defined within a fuel rail socket body along a fuel rail socket axis; a fuel injector retention groove defined on a fuel injector upper housing of a fuel injector; a first retention bore defined in the fuel rail socket body along a first retention bore axis that is substantially perpendicular to the fuel rail socket axis; a second retention bore defined in the fuel rail socket body along a second retention bore axis that is substantially perpendicular to the fuel rail socket axis; a first retention pin disposed within the first retention bore and the fuel injector retention groove; a second retention pin disposed within the second retention bore and the fuel injector retention groove; and a retention pin retaining
(Continued)

member which retains the first and second retention pins in the first and second retention bores respectively.

22 Claims, 9 Drawing Sheets

(51) Int. Cl.
*F02M 69/46* (2006.01)
*F02M 55/02* (2006.01)

(52) U.S. Cl.
CPC ..... *F02M 69/465* (2013.01); *F02M 55/025* (2013.01); *F02M 2200/853* (2013.01); *F02M 2200/856* (2013.01); *F02M 2200/857* (2013.01)

(58) Field of Classification Search
USPC ..... 123/470, 456, 477, 468, 469
See application file for complete search history.

(56) References Cited

U.S. PATENT DOCUMENTS

| | | | | |
|---|---|---|---|---|
| 6,148,799 | A | 11/2000 | Leipelt et al. | |
| 7,252,249 | B2 | 8/2007 | Molnar | |
| 7,798,127 | B2 | 9/2010 | Notaro et al. | |
| 7,856,962 | B2 | 12/2010 | Harvey et al. | |
| 7,938,455 | B2 * | 5/2011 | Rapp | F02M 55/002 285/305 |
| 8,479,710 | B2 | 7/2013 | Davis | |
| 8,646,434 | B2 | 2/2014 | Harvey et al. | |
| 8,813,722 | B2 | 8/2014 | Harvey et al. | |
| 2004/0051313 | A1 * | 3/2004 | Trouyet | F16L 37/088 285/305 |
| 2006/0137659 | A1 | 6/2006 | Zdroik et al. | |
| 2008/0302336 | A1 * | 12/2008 | Fuerst | F02M 55/025 123/470 |
| 2010/0012093 | A1 | 1/2010 | Pepperine et al. | |
| 2010/0156092 | A1 * | 6/2010 | Rapp | F02M 55/002 285/82 |
| 2012/0067982 | A1 | 3/2012 | Perry et al. | |
| 2016/0025053 | A1 * | 1/2016 | Reinhardt | F02M 61/14 239/584 |

FOREIGN PATENT DOCUMENTS

| | | | |
|---|---|---|---|
| WO | 2009039021 | A1 | 3/2009 |
| WO | 2013160038 | A1 | 10/2013 |
| WO | 2013160064 | A1 | 10/2013 |
| WO | 2015106862 | A1 | 7/2015 |

OTHER PUBLICATIONS

EP 16159769 Search Report Dated Jul. 13, 2016.

* cited by examiner

ARRANGEMENT FOR RETAINING A FUEL INJECTOR TO A FUEL RAIL SOCKET

TECHNICAL FIELD OF INVENTION

The present invention relates to fuel injectors for supplying fuel to a fuel consuming device and more particularly to an arrangement for retaining such a fuel injector to a fuel rail socket.

BACKGROUND OF INVENTION

Modern internal combustion engines typically utilize one or more fuel injectors for metering a precise quantity of fuel to be combusted in respective combustion chambers such that the combustion is initiated, by way of non-limiting example only, with a spark from a spark plug. Combustion of the fuel may be used, for example, to propel a motor vehicle and to generated electricity or drive other accessories in support of operation of the motor vehicle. Fuels in liquid form that are commonly used to power the internal combustion engine include, by way of non-limiting example only, gasoline, ethanol, alcohol, diesel fuel, and the like and blends of two or more thereof. Until more recently, fuel injectors commonly referred to as port fuel injectors were predominantly used. Port fuel injectors inject fuel into a port of an intake manifold where the fuel is mixed with air prior to being drawn into the combustion chamber of the internal combustion through an intake valve of the cylinder head. A typical port fuel injector is show in U.S. Pat. No. 7,252,249 to Molnar. In order to increase fuel economy and reduce undesirable emissions produced by combustion of the fuel, direct injection fuel injectors have been increasing in use. As the name suggests, direct injection fuel injectors inject fuel directly into the combustion chamber. An example of such a direct injection fuel injector is described in Unites States Patent Application Publication No. US 2012/0067982 A1 to Perry et al., the disclosure of which is incorporated herein by reference in its entirety.

In a typical internal combustion engine, a plurality of direct injection fuel injectors such as those disclosed in Perry et al. are attached to a common volume of a fuel rail which contains pressurized fuel. The fuel rail includes a plurality of fuel rail sockets which each receive a portion of a respective fuel injector therein. In use, the pressurized fuel acts on the fuel injectors, thereby trying to push the fuel injectors out of their respective fuel rail sockets. It may be desirable to suspend the fuel injectors from their respective fuel rail sockets in order to minimize contact between the internal combustion engine and the fuel injectors, thereby minimizing noise and heat transfer. U.S. Pat. Nos. 8,646,434; 8,813,722; and 7,856,962 to Harvey et al.; U.S. Pat. No. 8,479,710 to Davis; and U.S. Pat. No. 7,798,127 to Notaro et al.; United Stated Patent Application Publication No. US 2010/0012093 A1 to Pepperine et al.; and Research Disclosure Publication No. 601008 teach various arrangements for retaining a fuel injector to a fuel rail socket. However, these various arrangements for retaining the fuel injector to the fuel rail socket may be costly and difficult to implement. Furthermore some of these arrangements for retaining the fuel injector to the fuel rail socket may not be satisfactory when subjected to fuel pressures which are ever increasing in an attempt to achieve greater efficiency and reduced emissions. Consequently, improvements in retaining the fuel injector to the fuel rail socket are always sought.

What is needed is an arrangement for retaining a fuel injector to a fuel rail socket which minimizes or eliminates one or more of the shortcomings set forth above.

SUMMARY OF THE INVENTION

Briefly described, a fuel injector retention arrangement is provided for retaining a fuel injector to a fuel rail socket of a fuel rail where the fuel injector has a fuel injector upper housing which defines a fuel inlet to the fuel injector, the fuel rail socket has a fuel rail socket body, and the fuel rail has a fuel rail volume which receives pressurized fuel. The fuel injector retention arrangement includes a fuel rail socket interior space defined within the fuel rail socket body such that the fuel rail socket interior space extends into the fuel rail socket body along a fuel rail socket axis, the fuel rail socket interior space being in fluid communication with the fuel rail volume; a fuel injector retention groove defined on the fuel injector upper housing such that the fuel injector retention groove is disposed within the fuel rail socket interior space and such that the fuel inlet is in fluid communication with the fuel rail socket interior; a first retention bore defined in the fuel rail socket body and extending into the fuel rail socket interior space such that the first retention bore extends along a first retention bore axis that is substantially perpendicular to the fuel rail socket axis such that the first retention bore axis is laterally offset from the fuel rail socket axis; a second retention bore defined in the fuel rail socket body and extending into the fuel rail socket interior space such that the second retention bore extends along a second retention bore axis that is substantially perpendicular to the fuel rail socket axis such that the second retention bore axis is laterally offset from the fuel rail socket axis; a first retention pin disposed within the first retention bore such that the first retention pin extends through the fuel injector retention groove; a second retention pin disposed within the second retention bore such that the second retention pin extends through the fuel injector retention groove; and a retention pin retaining member which retains the first retention pin in the first retention bore and also retains the second retention pin in the second retention bore. The first retention pin within the first retention bore extending through the fuel injector retention groove and the second retention pin within the second retention bore extending through the fuel injector retention groove retain the fuel injector to the fuel rail socket. Such an arrangement for retaining a fuel injector to a fuel rail socket provides a robust connection that is inexpensive and simple to produce and assemble.

BRIEF DESCRIPTION OF DRAWINGS

This invention will be further described with reference to the accompanying drawings in which.

DETAILED DESCRIPTION OF INVENTION

Figure 1:
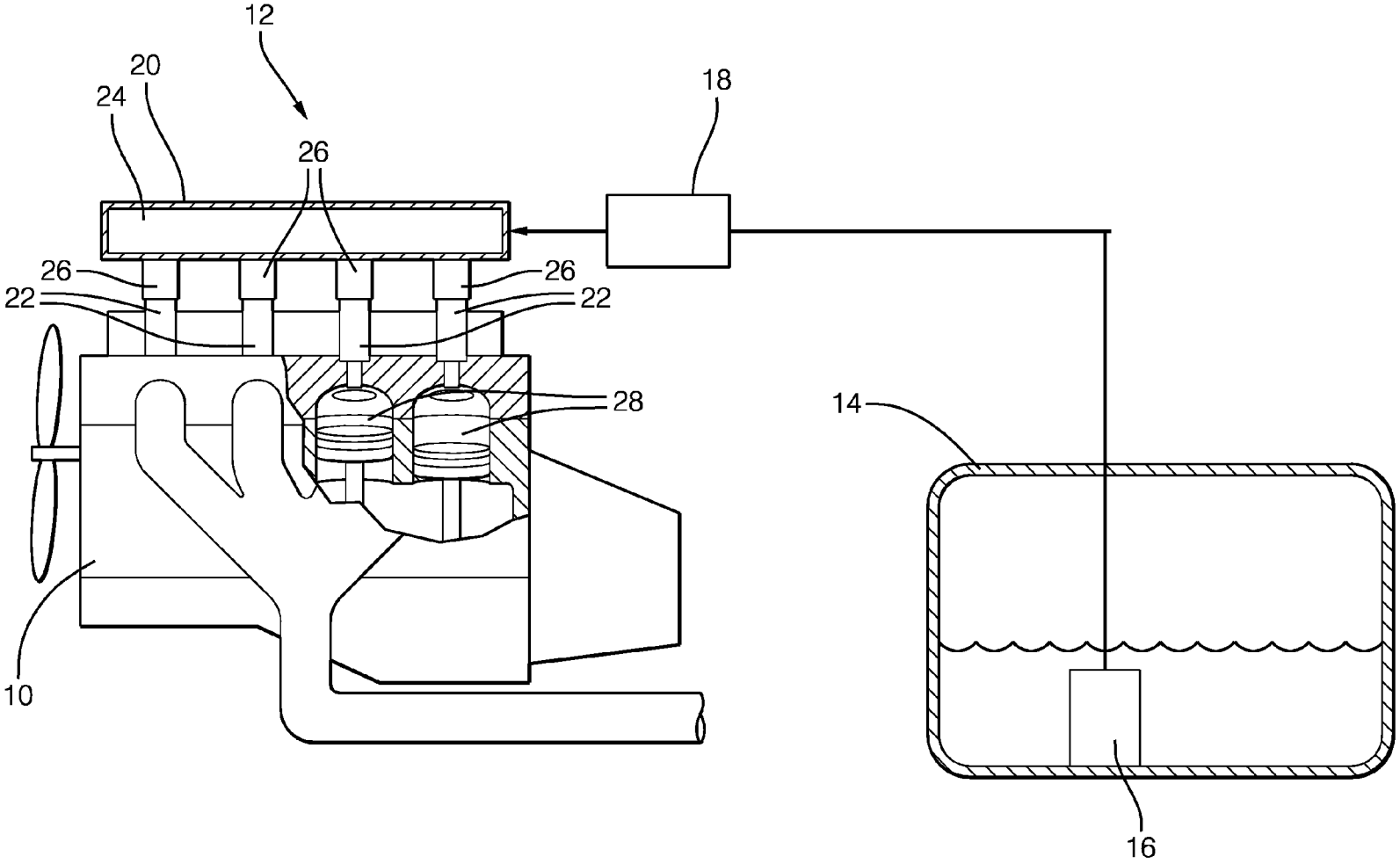
FIG. 1 is a schematic view of an internal combustion engine and a fuel system for the internal combustion engine.

Reference will first be made to FIG. 1 which shows a fuel consuming device, illustrated as internal combustion engine 10, and a fuel system 12 for supplying fuel to internal combustion engine 10. The fuel supplied to internal combustion engine 10 by fuel system 12 may be, by way of non-limiting example only, gasoline, ethanol, alcohol, diesel fuel, and the like and blends of two or more thereof. As shown herein, fuel system 12 may include a fuel tank 14, a lift pump 16, a high pressure pump 18, a fuel rail 20, and a plurality of fuel injectors 22. Fuel tank 14 stores a volume of fuel which is pumped at relatively low pressure by lift pump 16 to high pressure pump 18. High pressure pump 18 pumps the fuel at a relatively high pressure to a fuel rail volume 24 defined within fuel rail 20. Fuel rail 20 includes a plurality of fuel rail sockets 26 within which a portion of fuel injectors 22 are received and retained. Fuel injectors 22 are each in fluid communication with fuel rail volume 24 through fuel rail sockets 26 in order to receive the pressurized fuel. Each fuel injector 22 is configured to selectively supply fuel to a respective combustion chamber 28 (only two combustion chambers 28 are visible in FIG. 1) where the fuel is combusted in known fashion. Fuel injectors 22 may take numerous forms, but may be a fuel injector as describe in Unites States Patent Application Publication No. US 2012/0067982 A1 to Perry et al., the disclosure of which is incorporated herein by reference in its entirety. While fuel system 12 has been described herein as a fuel system in which fuel is injected directly into combustion chambers 28, it should now be understood that fuel system 12 could alternatively be a fuel system in which the fuel is not injected directly into combustion chambers 28, which may be, by way of non-limiting example only, a port fuel injection system where the fuel injectors inject the fuel into an intake manifold where the fuel and air are introduced into each combustion chamber together through a respective intake combustion valve. In a port fuel injection system, high pressure pump 18 may be omitted and fuel is delivered directly to the fuel rail volume by the lift pump.

Figure 2:
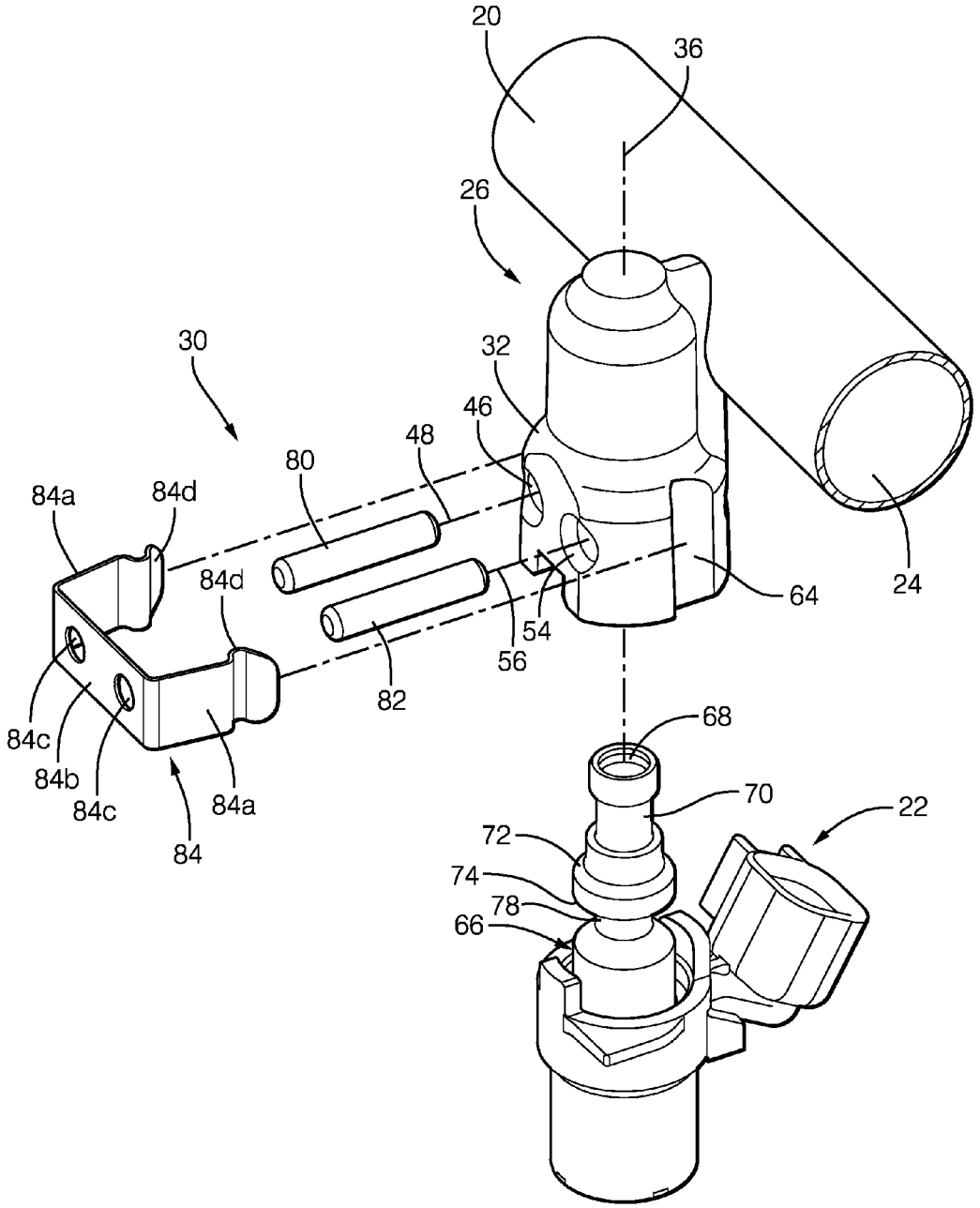
FIG. 2 is an exploded isometric view of a fuel injector retention arrangement in accordance with the present invention.
Figure 3:
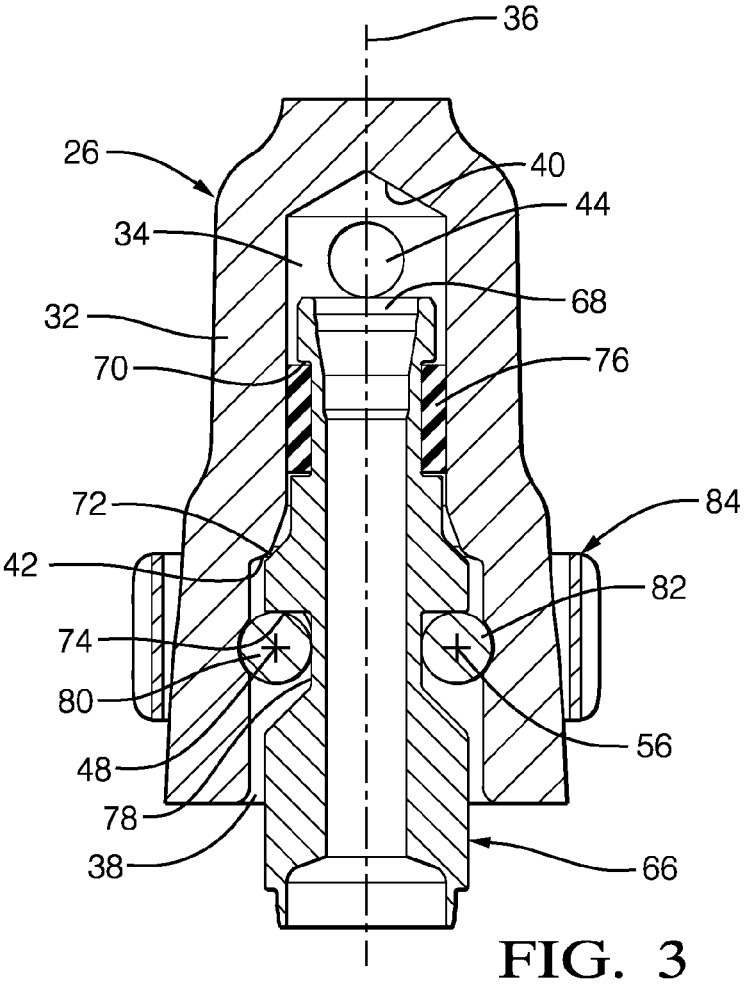
FIG. 3 is an axial cross-sectional view of the fuel injector retention arrangement of FIG. 2.
Figure 4:
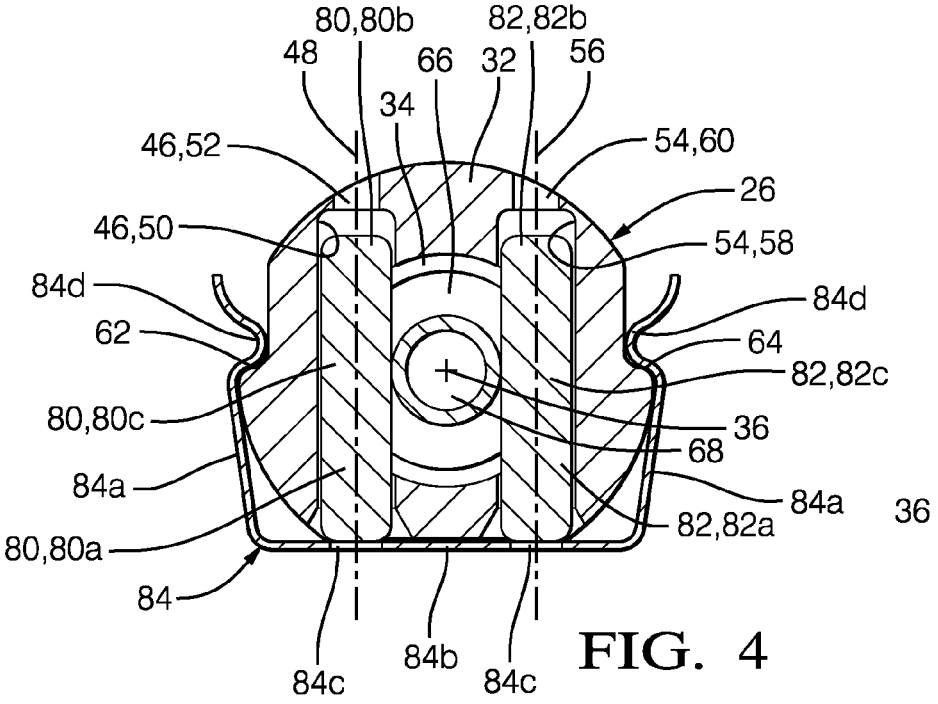
FIG. 4 is a radial cross-sectional view of the fuel injector retention arrangement of FIG. 2.

With continued reference to FIG. 1 and now with additional reference to FIGS. 2-4, a fuel injector retention arrangement 30 in accordance with a preferred embodiment of this invention will be described. Each fuel injector 22 may be retained to its respective fuel injector socket 26 in the same way; and consequently, the description that follows will refer to one fuel rail socket 26 and one fuel injector 22 with the understanding that the description is equally applicable to each pair of fuel rail sockets 26 and fuel injectors 22.

Fuel rail socket 26 has a fuel rail socket body 32 with a fuel rail socket interior space 34 defined therein. Fuel rail socket interior space 34 extends into fuel rail socket body 32 along a fuel rail socket axis 36 from an open end 38 to a closed end 40 such that fuel rail socket interior space 34 is stepped, thereby defining a fuel rail socket shoulder 42 therein which faces toward open end 38. Fuel rail socket 26 is fixed to fuel rail 20, by way of non-limiting example only, by welding or brazing. Fluid communication between fuel rail volume 24 and fuel rail socket interior space 34 is provided by a fuel passage 44 which extends from fuel rail volume 24 to fuel rail socket interior space 34 through fuel rail 20 and fuel rail socket body 32.

A first retention bore 46 extends through fuel rail socket body 32 along a first retention bore axis 48 that is substantially perpendicular to fuel rail socket axis 36 and laterally offset from fuel rail socket axis 36 such that first retention bore 46 opens up into fuel rail socket interior space 34. First retention bore 46 may be stepped as shown, thereby defining a first retention bore main portion 50 and a first retention bore inspection window 52 as will be described in greater detail later. Similarly, a second retention bore 54 extends through fuel rail socket body 32 along a second retention bore axis 56 that is substantially perpendicular to fuel rail socket axis 36 and laterally offset from fuel rail socket axis 36 such that second retention bore 54 opens up into fuel rail socket interior space 34. Additionally, second retention bore axis 56 is substantially parallel to first retention bore axis 48 and second retention bore axis 56 is laterally offset to the side of fuel rail socket axis 36 that is opposite of fuel rail socket axis 36 such that fuel rail socket axis 36 is between first retention bore axis 48 and second retention bore axis 56. Second retention bore 54 may be stepped as shown, thereby defining a second retention bore main portion 58 and a second retention bore inspection window 60 as will be described in greater detail later.

Fuel rail socket body 32 defines a first retention shoulder 62 which extends along the outside surface of fuel rail socket body 32 in a direction substantially parallel to fuel rail socket axis 36. Fuel rail socket body 32 also defines a second retention shoulder 64 which extends along the outside surface of fuel rail socket body 32 in a direction that is substantially parallel to first retention shoulder 62 such that first retention bore axis 48 and second retention bore axis 56 are located between first retention shoulder 62 and second retention shoulder 64.

Fuel injector 22 includes a fuel injector upper housing 66 which is received coaxially within fuel rail socket interior space 34 and which defines a fuel inlet 68 to fuel injector 22 which receives fuel from fuel rail socket interior space 34. Fuel injector upper housing 66 has a multi-diameter exterior surface which defines a seal groove 70, a fuel injector stop shoulder 72 which faces toward fuel rail socket shoulder 42, and a fuel injector retention shoulder 74 which is substantially perpendicular to fuel rail socket axis 36 and which faces away from fuel rail socket shoulder 42. Fuel injector stop shoulder 72 interfaces with fuel rail socket shoulder 42 to limit the extent to which fuel injector upper housing 66 can be inserted into fuel rail socket interior space 34. A seal 76 is located within seal groove 70, thereby providing a fuel-tight seal between fuel injector upper housing 66 and fuel rail socket 26 in order to prevent fuel from escaping to the environment from fuel rail socket interior space 34. Fuel injector retention shoulder 74, as shown, may be defined by a fuel injector retention groove 78 which is aligned with first retention bore 46 and second retention bore 54. Alternatively, fuel injector retention shoulder 74 may be defined by opposing straight grooves that are aligned with first retention bore 46 and second retention bore 54 respectively, thereby separating fuel injector retention shoulder 74 into two distinct sections.

A first retention pin 80 is disposed within first retention bore 46 such that a first retention pin first end 80*a* and a first retention pin second end 80*b* are each circumferentially surrounded by respective ends of first retention bore 46 while a first retention pin central portion 80*c* of first retention pin 80 which is between first retention pin first end 80*a* and first retention pin second end 80*b* is located within fuel rail socket interior space 34 and extends through fuel injector retention groove 78. Similarly, a second retention pin 82 is disposed within second retention bore 54 such that a second retention pin first end 82*a* and a second retention pin second end 82*b* are each circumferentially surrounded by respective ends of second retention bore 54 while a second retention pin central portion 82*c* of second retention pin 82 which is between second retention pin first end 82*a* and second retention pin second end 82*b* is located within fuel rail socket interior space 34 and extends through fuel injector retention groove 78. Fuel injector retention shoulder 74 rests on first retention pin central portion 80*c* and second retention pin central portion 82*c*, thereby resisting forces from the pressurized fuel within fuel rail socket interior space 34 and preventing fuel injector upper housing 66 from coming out of fuel rail socket interior space 34 and also thereby retaining fuel injector 22 to fuel rail socket 26. First retention pin 80 and second retention pin 82 may each be cylindrical, thereby allowing first retention pin 80 and second retention pin 82 to be selected from readily available and inexpensive stock, by way of non-limiting example only, hardened roller bearings. First retention pin 80 is diametrically sized to be sufficiently small to allow first retention pin 80 to slide into first retention bore main portion 50 without restriction. However, first retention pin 80 is diametrically sized to be sufficiently large to prevent first retention pin 80 from passing through first retention bore inspection window 52. Consequently first retention bore inspection window 52 allows verification, either visually or with a probe, that first retention pin 80 is properly located within first retention bore 46. First retention bore inspection window 52 also allows access to first retention pin 80 to allow first retention pin 80 to be drifted out of first retention bore 46 when it is necessary to disassemble fuel injector 22 from fuel rail socket 26. Similarly, second retention pin 82 is diametrically sized to be sufficiently small to allow second retention pin 82 to slide into second retention bore main portion 58 without restriction. However, second retention pin 82 is diametrically sized to be sufficiently large to prevent second retention pin 82 from passing through second retention bore inspection window 60. Consequently second retention bore inspection window 60 allows verification, either visually or with a probe, that second retention pin 82 is properly located within second retention bore 54. Second retention bore inspection window 60 also allows access to second retention pin 82 to allow second retention pin 82 to be drifted out of second retention bore 54 when it is necessary to disassemble fuel injector 22 from fuel rail socket 26.

A retention pin retaining member, illustrated as retention clip 84, is provided in order to retain first retention pin 80 and second retention pin 82 within first retention bore 46 and second retention bore 54 respectively. Retention clip 84 is resilient and compliant and configured to grasp the outer surface of fuel rail socket body 32 and also configured to provide an obstruction to first retention bore 46 and second retention bore 54. More specifically, retention clip 84 includes opposing retention arms 84*a* which are joined together by an integrally formed bridge section 84*b*. Bridge section 84*b* is substantially perpendicular to first retention bore axis 48 and second retention bore axis 56 while each retention arm 84*a* extends obliquely from respective ends of bridge section 84*b*, thereby making retention clip 84 C-shaped, however, retention arms 84*a* could also extend from bridge section 84*b* at right angles. When retention clip 84 is assembled to fuel rail socket body 32, bridge section 84*b* is located over the ends of first retention bore main portion 50 and second retention bore main portion 58, thereby blocking first retention bore main portion 50 and second retention bore main portion 58. Bridge section 84*b* may include retention clip inspection windows 84*c* extending therethrough which are each aligned with a respective one of first retention bore main portion 50 and second retention bore main portion 58. Retention clip inspection windows 84*c* allow verification, either visually or with a probe, that first retention pin 80 and second retention pin 82 are properly located within first retention bore 46 and second retention bore 54 respectively, however, retention clip inspection windows 84*c* are sized to be sufficiently small in order to prevent first retention pin 80 and second retention pin 82 from passing therethrough. Each retention arm 84*a* includes a retention arm catch 84*d* which protrudes from retention arm 84*a* toward fuel rail socket body 32 such that one each retention arm catch 84*d* snaps over first retention shoulder 62 while the other retention arm catch 84*d* snaps over second retention shoulder 64. When retention clip 84 is assembled to fuel rail socket body 32, retention clip 84 may be displaced along first retention bore axis 48 and second retention bore axis 56, thereby causing retention arms 84*a* to be resiliently displaced outward by the outer surface of fuel rail socket body 32 until retention clip 84 is displaced sufficiently far which causes retention arms 84*a* to snap inward over first retention shoulder 62 and second retention shoulder 64. While the retention pin retaining member has been illustrated as retention clip 84 which serves to retain both first retention pin 80 and second retention pin 82 simultaneously, it should now be understood that the retention pin retaining pin retaining member may alternatively take a form in which one piece retains first retention pin 80 and a second piece retains second retention pin 82 independently from first retention pin 80.

Figure 5:
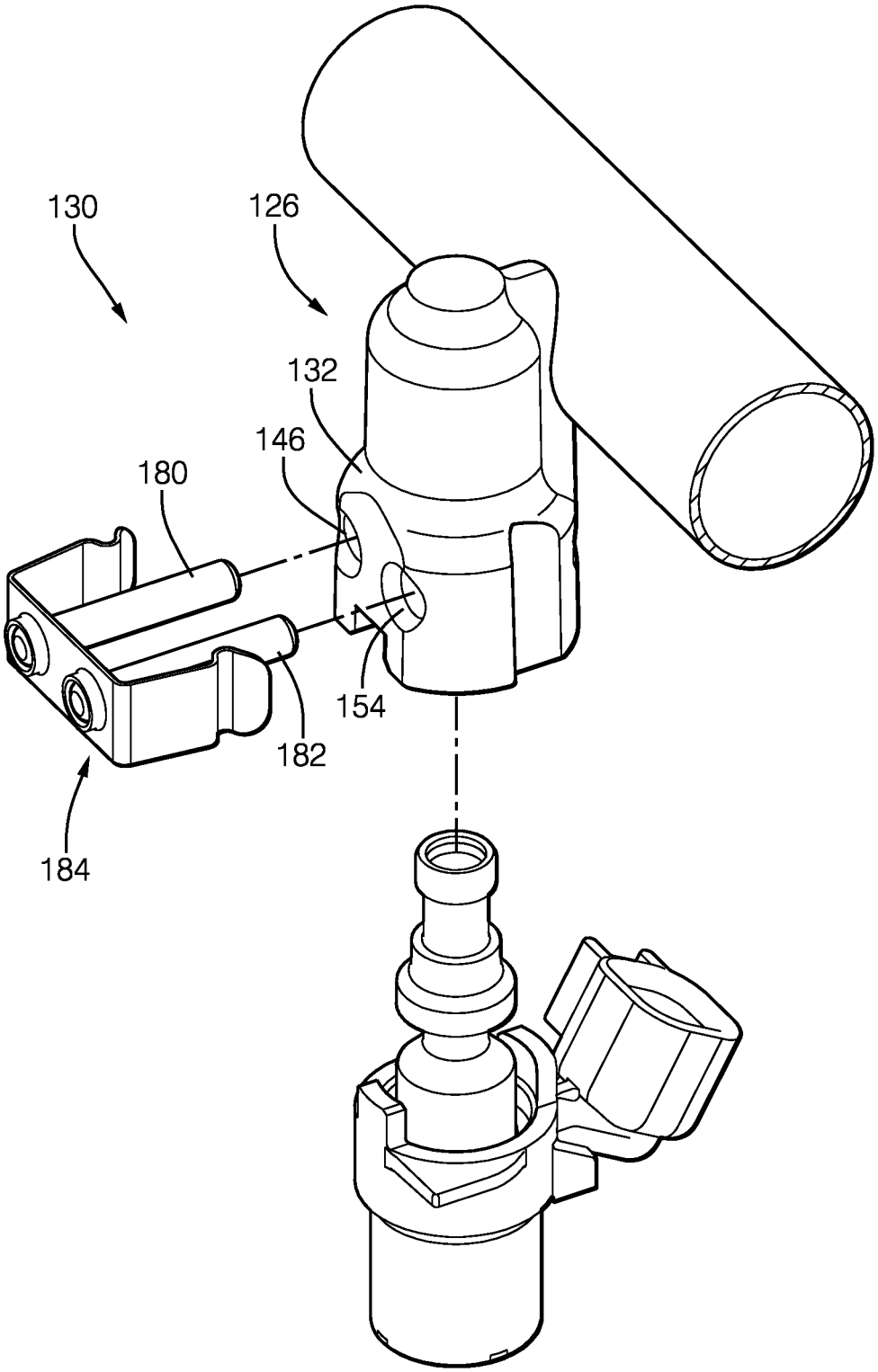
FIG. 5 is an exploded isometric view of a second fuel injector retention arrangement in accordance with the present invention.
Figure 6:
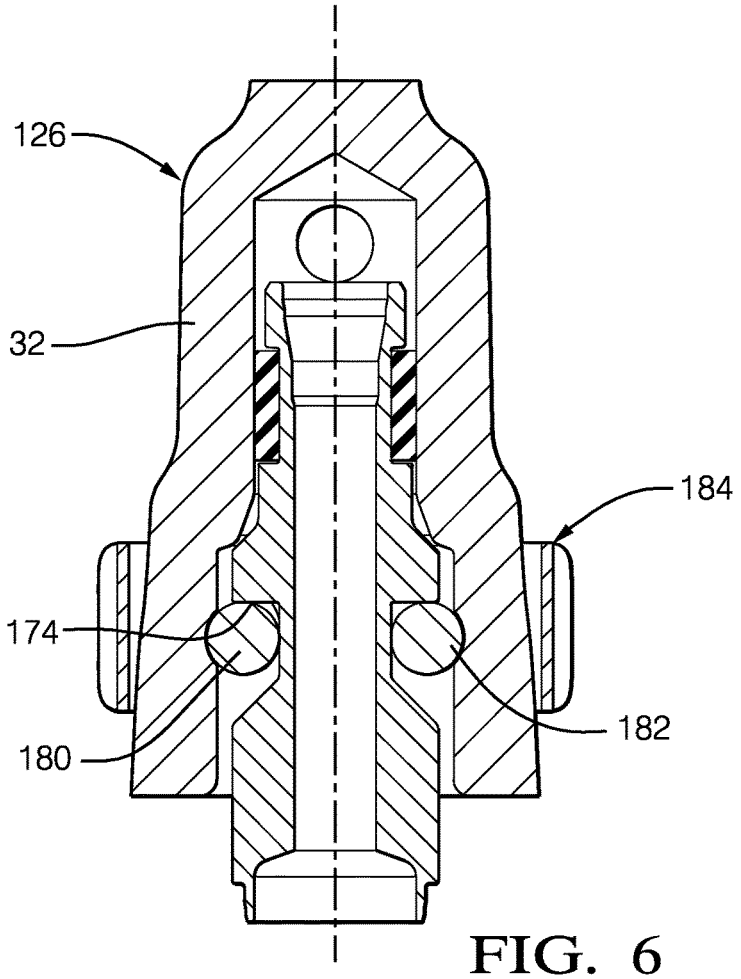
FIG. 6 is an axial cross-sectional view of the fuel injector retention arrangement of FIG. 5.
Figure 7:
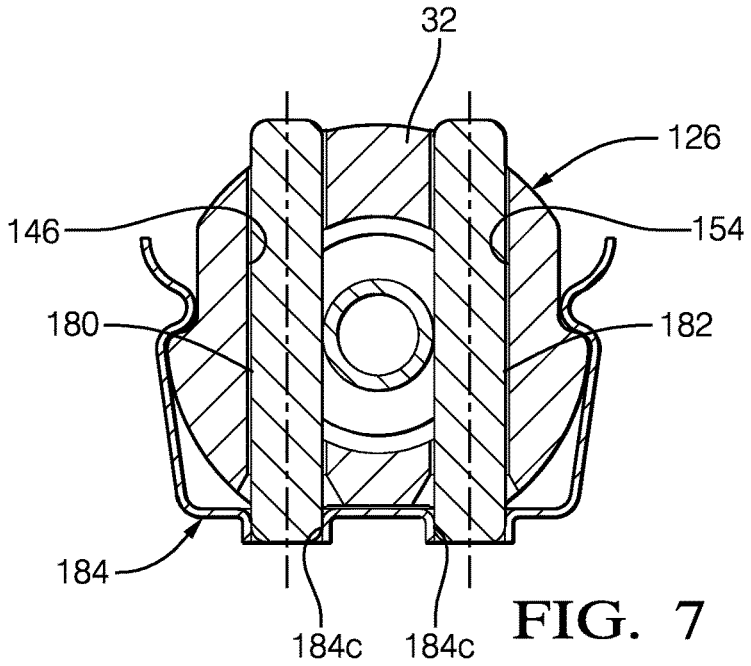
FIG. 7 is a radial cross-sectional view of the fuel injector retention arrangement of FIG. 5.

Now with reference to FIGS. 5-7, a fuel injector retention arrangement 130 in accordance with a second preferred embodiment of this invention will be described. In the description of fuel injector retention arrangement 130, features thereof that correspond to features of fuel injector retention arrangement 30 will use reference numbers increased by one hundred.

Fuel injector retention arrangement 130 is substantially the same as fuel injector retention arrangement 30 except that first retention bore 146 and second retention bore 154 of fuel rail socket 126 each may extend through fuel rail socket body 132 in a uniform diameter and first retention pin 180 and second retention pin 182 are fixed to retention clip 184. Furthermore, retention clip inspection windows 84*c* may be replaced by retention clip fixing apertures 184*c*. First retention pin 180 and second retention pin 182 may be fixed to retention clip 184 by press fit and/or welded within their respective retention clip fixing aperture 184*c*. Since first retention pin 180 and second retention pin 182 are fixed to retention clip 184, there are fewer loose pieces to handle and it may be easier to verify that first retention pin 180 and second retention pin 182 are properly located within first retention bore 146 and second retention bore 154 respectively by verifying that retention clip 184 has been properly installed.

Figure 8:
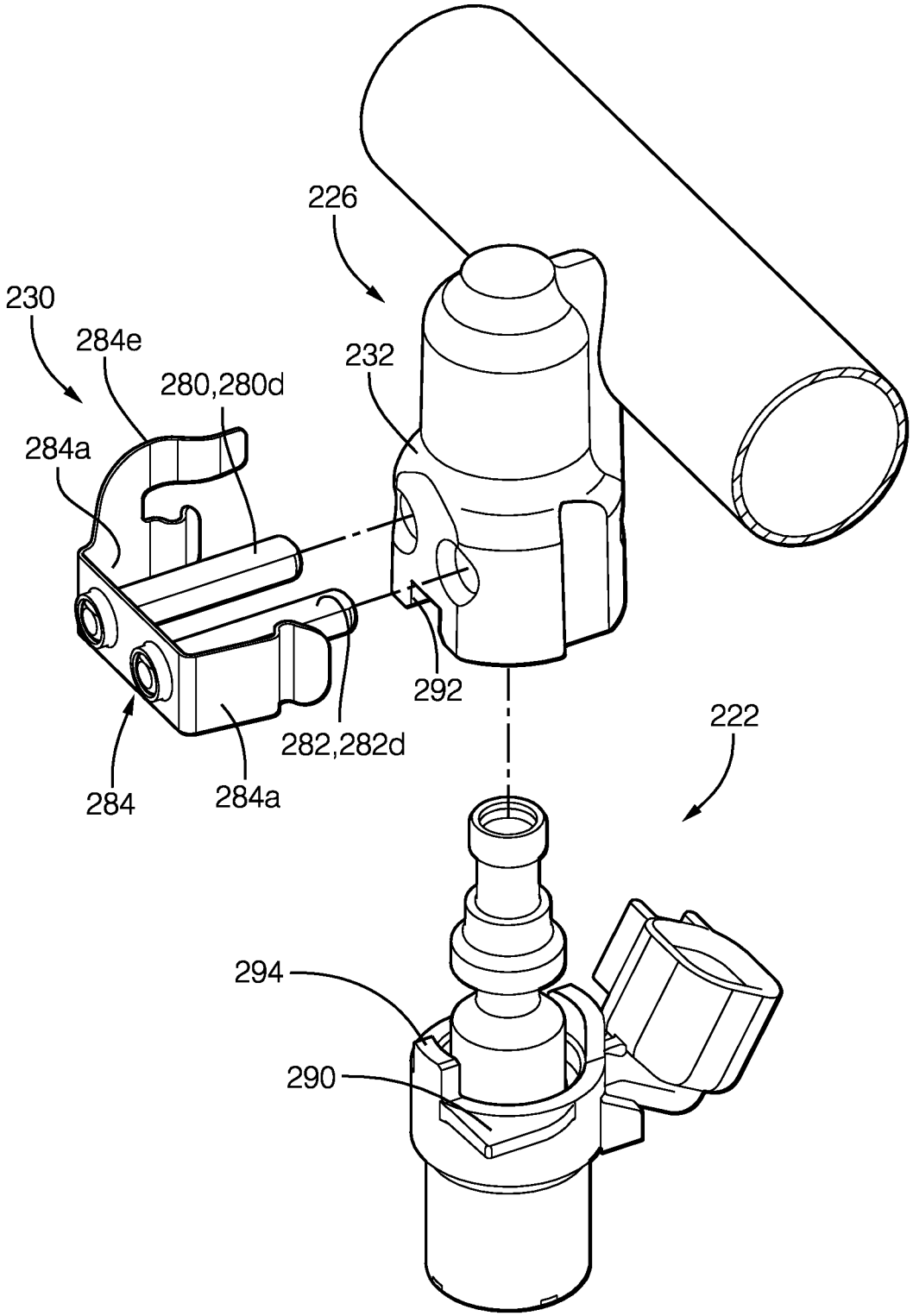
FIG. 8 is an exploded isometric view of a third fuel injector retention arrangement in accordance with the present invention.
Figure 9:
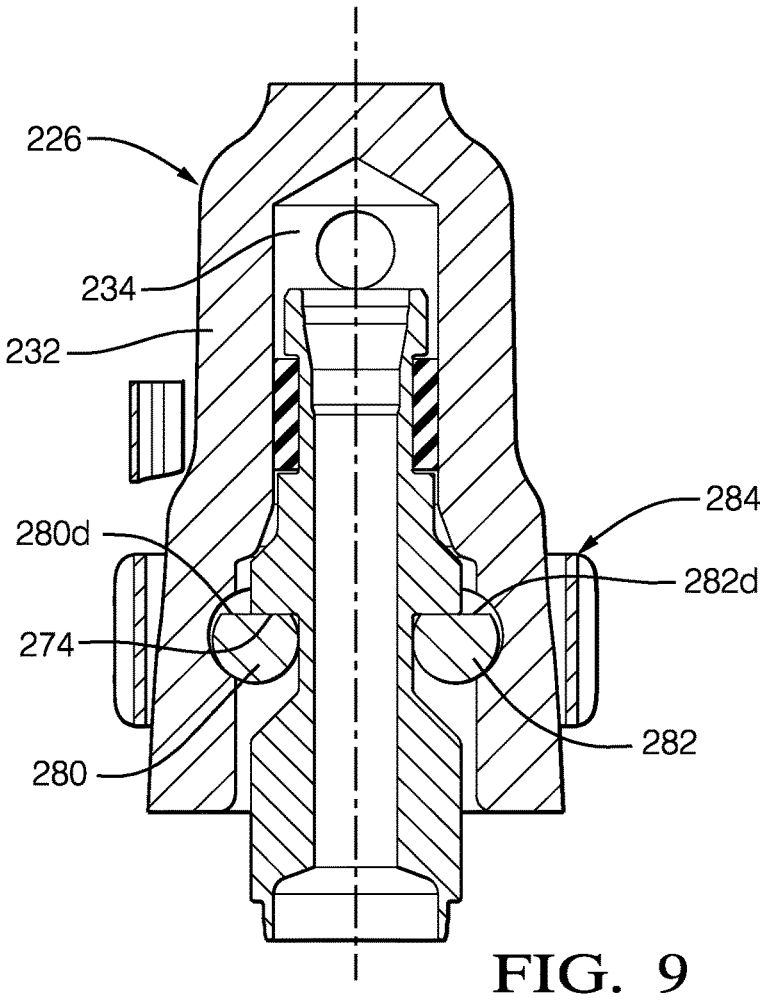
FIG. 9 is an axial cross-sectional view of the fuel injector retention arrangement of FIG. 8.
Figure 10:
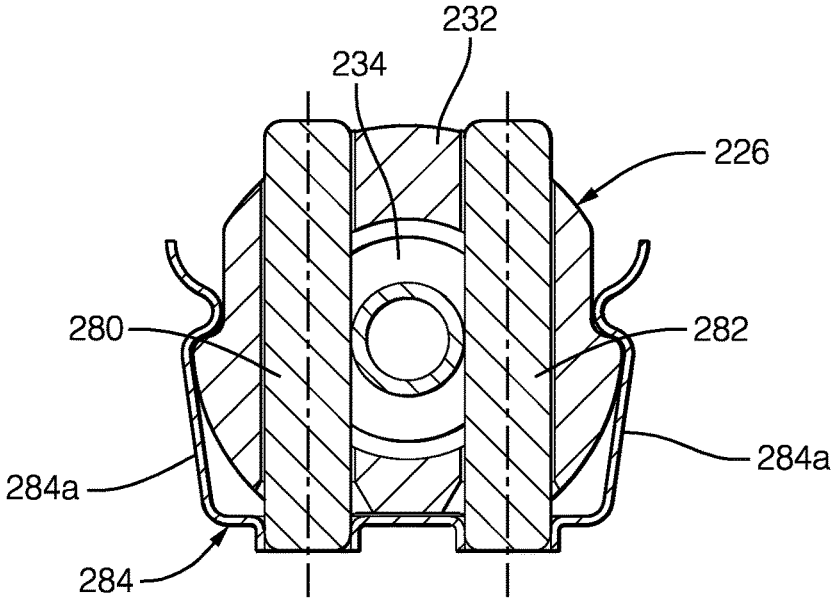
FIG. 10 is a radial cross-sectional view of the fuel injector retention arrangement of FIG. 8.

Now with to FIGS. 8-10, a fuel injector retention arrangement 230 in accordance with a third preferred embodiment of this invention will be described. In the description of fuel injector retention arrangement 230, features thereof that correspond to features of fuel injector retention arrangement 30 and fuel injector retention arrangement 130 will use reference numbers increased by two hundred compared to fuel injector retention arrangement 30 and increased by one hundred compared to fuel injector retention arrangement 130.

Fuel injector retention arrangement 230 is similar to fuel injector retention arrangement 130 in that first retention pin 280 and second retention pin 282 are fixed to retention clip 284. However, first retention pin 280 differs from first retention pin 180 in that first retention pin 280 includes a first retention pin flat 280*d* that is substantially parallel to and facing toward fuel injector retention shoulder 274. Similarly, second retention pin 282 differs from second retention pin 182 in that second retention pin 282 includes a second retention pin flat 282*d* that is substantially parallel to and facing toward fuel injector retention shoulder 274. First retention pin flat 280*d* increases the contact area between first retention pin 280 and fuel injector retention shoulder 274, and consequently reduces the contact stress between first retention pin 280 and fuel injector retention shoulder 274. Similarly, second retention pin flat 282*d* increases the contact area between second retention pin 282 and fuel injector retention shoulder 274, and consequently reduces the contact stress between second retention pin 282 and fuel injector retention shoulder 274.

In order to ensure proper orientation of first retention pin flat 280*d* and second retention pin flat 282*d*, fuel injector 222 and retention clip 284 are provided with features which prevent retention clip 284 from being assembled to fuel rail socket 226 in an orientation that would face first retention pin flat 280*d* and second retention pin flat 282*d* away from fuel injector retention shoulder 274. More specifically, retention clip 284 includes a retention clip orientation arm 284*e* which extends from one retention arm 284*a* and fuel injector 222 includes a fuel injector orientation tab 290 extending therefrom. Fuel injector orientation tab 290 may preferably be integrally formed with a portion of fuel injector 222 that is formed by injection molding, and consequently, fuel injector orientation tab 290 may be easily and economically formed. When retention clip 284 is properly oriented to face first retention pin flat 280*d* and second retention pin flat 282*d* toward fuel injector retention shoulder 274, fuel injector orientation tab 290 does not interfere with retention clip orientation arm 284*e*. Consequently, retention clip 284 together with first retention pin 280 and second retention pin 282 are able to be properly assembled with fuel rail socket 226 with first retention pin flat 280*d* and second retention pin flat 282*d* facing toward fuel injector retention shoulder 274. Conversely, when retention clip 284 is improperly oriented to face first retention pin flat 280*d* and second retention pin flat 282*d* away from fuel injector retention shoulder 274, fuel injector orientation tab 290 interferes with retention clip orientation arm 284*e*. Consequently, retention clip 284 together with first retention pin 280 and second retention pin 282 are unable to be assembled with fuel rail socket 226.

In order to orient fuel injector 222 relative to fuel rail socket 226, fuel rail socket 226 may include a fuel rail socket alignment notch 292 which extends into the same end of fuel rail socket body 232 that fuel fail socket interior space 234 extends into. Fuel injector 222 includes a complementary alignment tab 294 which extends therefrom and is received within fuel rail socket alignment notch 292, thereby ensuring that fuel injector 222 is properly oriented relative to fuel rail socket 226, which may be important for, by way of non-limiting example only, aiming a fuel spray produced by fuel injector 222. While fuel rail socket alignment notch 292 and alignment tab 294 have only been described relative to orienting fuel injector 222, it should now be understood that equivalent features may be provided for orienting the fuel injectors of the embodiments shown in FIGS. 2-7.

Figure 11:
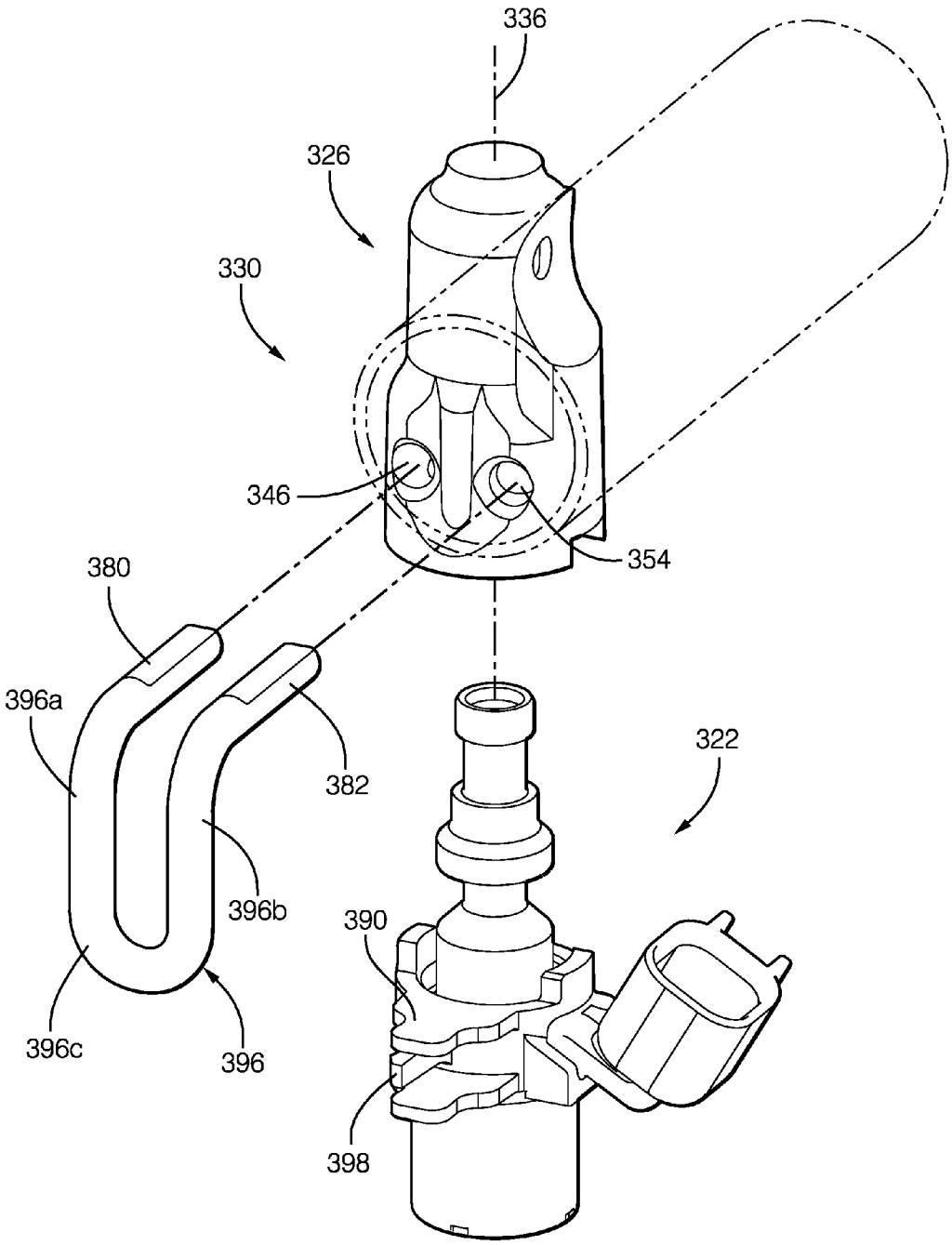
FIG. 11 is an exploded isometric view of a fourth fuel injector retention arrangement in accordance with the present invention.
Figure 12:
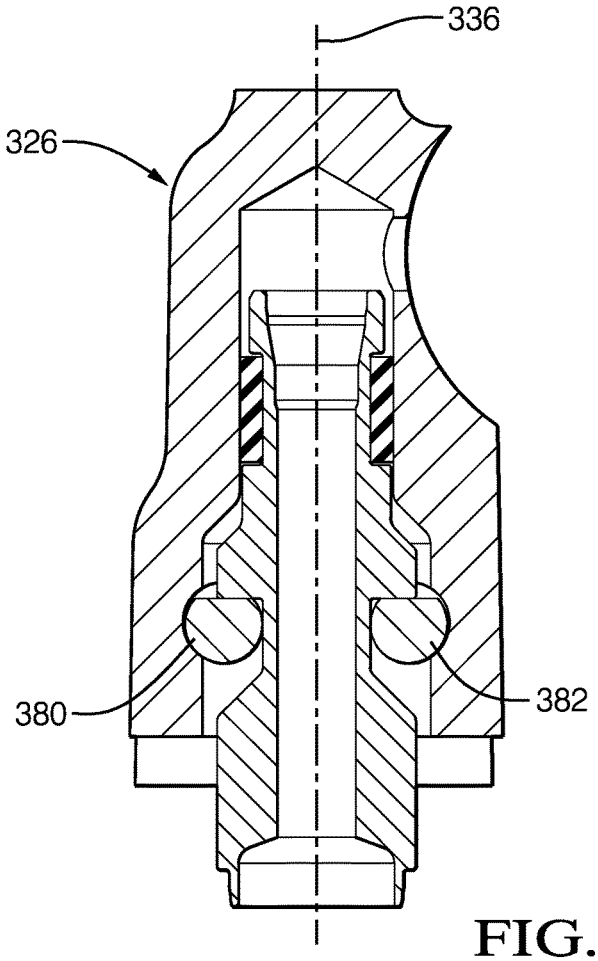
FIG. 12 is an axial cross-sectional view of the fuel injector retention arrangement of FIG. 11.
Figure 13:
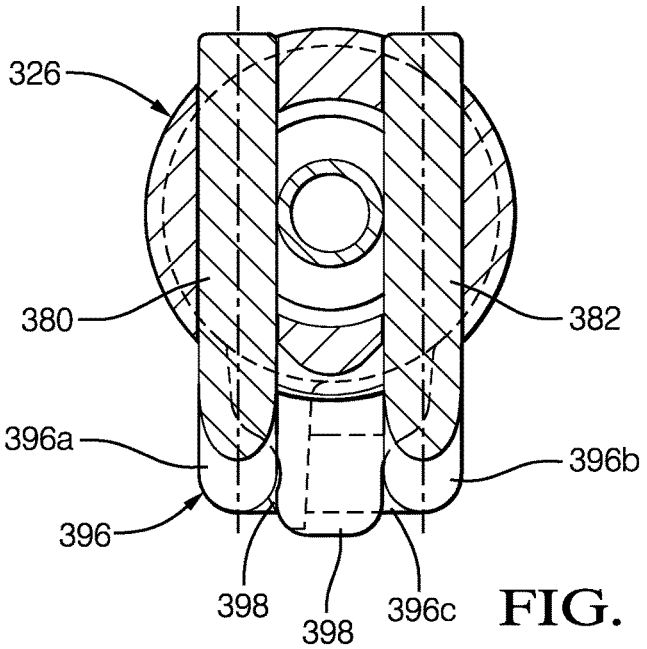
FIG. 13 is a radial cross-sectional view of the fuel injector retention arrangement of FIG. 11.

Now with reference to FIGS. 11-13, a fuel injector retention arrangement 330 in accordance with a fourth preferred embodiment of this invention will be described. In the description of fuel injector retention arrangement 330, features thereof that correspond to features of fuel injector retention arrangement 30, fuel injector retention arrangement 130, and fuel injector retention arrangement 230 will use reference numbers increased by three hundred compared to fuel injector retention arrangement 30, increased by two hundred compared to fuel injector retention arrangement 130, and increased by one hundred compared to fuel injector retention arrangement 230.

Fuel injector retention arrangement 330 differs from fuel injector retention arrangements 30, 130, 230 in that first retention pin 380 and second retention pin 382 are integrally formed from a single piece of material. As shown, a retention pin link 396 is integrally formed with first retention pin 380 and second retention pin 382. Retention pin link 396 includes a retention pin link first leg 396*a* which extends from first retention pin 380 in a direction that is substantially perpendicular to first retention pin 380 and in a direction that is parallel to fuel rail socket axis 336. Retention pin link 396 also includes a retention pin link second leg 396*b* which extends from second retention pin 382 in a direction that is substantially perpendicular to second retention pin 382 and in a direction that is parallel to fuel rail socket axis 334, and consequently, retention pin link second leg 396*b* is laterally offset from retention pin link first leg 396*a*. The ends of retention pin link first leg 396*a* and retention pin link second leg 396*b* that are opposite first retention pin 380 and second retention pin 382 respectively are joined by a retention pin link bridge 396*c*. As shown, retention pin link bridge 396*c* may be semicircular in shape. Fuel injector orientation tab 390 extends radially outward from fuel injector 322 and is located within the space between retention pin link first leg 396*a* and retention pin link second leg 396*b*. In this way, fuel injector orientation tab 390 and retention pin link 396 work together to orient fuel injector 322 relative to fuel rail socket 326. In fuel injector retention arrangement 330, the retention pin retaining member is illustrated as a retention latch 398 which is integrally formed with fuel injector 322. Retention latch 398 is resilient and compliant such that retention latch 398 is deflected by retention pin link 396 as first retention pin 380 and second retention pin 382 are being inserted in first retention pin bore 346 and second retention pin bore 354 respectively. When first retention pin 380 and second retention pin 382 are fully inserted in first retention pin bore 346 and second retention pin bore 354 respectively, retention latch 398 snaps over retention pin link first leg 396*a*, thereby retaining first retention pin 380 and second retention pin 382 within first retention pin bore 346 and second retention pin bore 354 respectively.

Fuel injector retention arrangements 30, 130, 230, and 330 as disclosed herein provide a robust connection while also being easy and economical to manufacture and assemble.

While this invention has been described in terms of the preferred embodiments thereof, it is not intended to be so limited, but rather only to the extent set forth in the claims that follow.

We claim:

1. A fuel injector retention arrangement for retaining a fuel injector to a fuel rail socket of a fuel rail, said fuel injector having a fuel injector upper housing which defines a fuel inlet to said fuel injector, said fuel rail socket having a fuel rail socket body, and said fuel rail having a fuel rail volume which receives pressurized fuel; said fuel injector retention arrangement comprising:

a fuel rail socket interior space defined within said fuel rail socket body such that said fuel rail socket interior space extends into said fuel rail socket body along a fuel rail socket axis, said fuel rail socket interior space being in fluid communication with said fuel rail volume;

a fuel injector retention groove defined on said fuel injector upper housing such that said fuel injector retention groove is disposed within said fuel rail socket interior space and such that said fuel inlet is in fluid communication with said fuel rail socket interior space;

a first retention bore defined in said fuel rail socket body and extending into said fuel rail socket interior space such that said first retention bore extends along a first retention bore axis that is substantially perpendicular to said fuel rail socket axis such that said first retention bore axis is laterally offset from said fuel rail socket axis;

a second retention bore defined in said fuel rail socket body and extending into said fuel rail socket interior space such that said second retention bore extends along a second retention bore axis that is substantially perpendicular to said fuel rail socket axis such that said second retention bore axis is laterally offset from said fuel rail socket axis;

a first retention pin disposed within said first retention bore such that said first retention pin extends through said fuel injector retention groove;

a second retention pin disposed within said second retention bore such that said second retention pin extends through said fuel injector retention groove; and a retention pin retaining member which retains said first retention pin in said first retention bore and also retains said second retention pin in said second retention bore;

whereby said first retention pin within said first retention bore extending through said fuel injector retention groove and said second retention pin within said second retention bore extending through said fuel injector retention groove retain said fuel injector to said fuel rail socket.

2. A fuel injector retention arrangement as in claim 1 wherein said first retention bore axis is parallel to said second retention bore axis.

3. A fuel injector retention arrangement as in claim 2 wherein said fuel rail socket axis is between said first retention bore axis and said second retention bore axis.

4. A fuel injector retention arrangement as in claim 1 wherein said first retention pin and said second retention pin are fixed to said retention pin retaining member.

5. A fuel injector retention arrangement as in claim 1 wherein said retention pin retaining member is a retention clip which blocks said first retention bore and also blocks said second retention bore.

6. A fuel injector retention arrangement as in claim 5 wherein said retention clip includes retention clip inspection windows extending therethrough which are open to said first retention bore and said second retention bore.

7. A fuel injector retention arrangement as in claim 5 wherein said retention clip is configured to grasp said fuel rail socket.

8. A fuel injector retention arrangement as in claim 1 wherein:

said first retention pin includes a first retention pin first end, a first retention pin second end, and a first retention pin central portion between said first retention pin first end and said first retention pin second end where said first retention pin first end and said first retention pin second end are each circumferentially surrounded by said first retention bore and said first retention pin central portion is disposed within said fuel rail socket interior space; and said second retention pin includes a second retention pin first end, a second retention pin second end, and a second retention pin central portion between said second retention pin first end and said second retention pin second end where said second retention pin first end and said second retention pin second end are each circumferentially surrounded by said first retention bore and said second retention pin central portion is disposed within said fuel rail socket interior space.

9. A fuel injector retention arrangement as in claim 1 wherein:

said first retention bore is stepped, thereby defining a first retention bore main portion and a first retention bore inspection window which extends from said first retention bore main portion through said fuel rail socket body such that said first retention bore inspection window is sized to prevent said first retention pin from passing through said first retention bore inspection window; and said second retention bore is stepped, thereby defining a second retention bore main portion and a second retention bore inspection window which extends from said second retention bore main portion through said fuel rail socket body such that said second retention bore inspection window is sized to prevent said second retention pin from passing through said second retention bore inspection window.

10. A fuel injector retention arrangement as in claim 1 wherein:

said fuel injector retention groove of said fuel injector upper housing defines a fuel injector retention shoulder facing toward said first retention pin and said second retention pin;

said first retention pin includes a first retention pin flat which faces toward and mates with said fuel injector retention shoulder; and said second retention pin includes a second retention pin flat which faces toward and mates with said fuel injector retention shoulder.

11. A fuel injector retention arrangement as in claim 10 wherein said fuel injector retention shoulder is substantially perpendicular to said fuel rail socket axis.

12. A fuel injector retention arrangement as in claim 1 wherein:

said fuel injector retention groove of said fuel injector upper housing defines a fuel injector retention shoulder facing toward said first retention pin and said second retention pin;

said retention pin retaining member is a retention clip;

said first retention pin and said second retention pin are fixed to said retention clip;

said first retention pin includes a first retention pin flat;

said second retention pin includes a second retention pin flat; and said retention clip and said fuel injector include features which permit said first retention pin and said second retention pin to be installed within said first retention bore and said second retention bore respectively only when said first retention pin flat faces toward said fuel injector retention shoulder and said second retention pin flat faces toward said fuel injector retention shoulder.

13. A fuel injector retention arrangement as in claim 12 wherein said retention clip is configured to grasp said fuel rail socket.

14. A fuel injector retention arrangement as in claim 1 wherein said retention pin retaining member is a retention clip which is configured to grasp said fuel rail socket.

15. A fuel injector retention arrangement as in claim 14 wherein said retention clip comprises:

a pair of opposing retention arms;

a bridge section which is integrally formed with said retention arms and joins said retention arms.

16. A fuel injector retention arrangement as in claim 15 wherein said bridge section blocks said first retention bore and said second retention bore.

17. A fuel injector retention arrangement as in claim 15 wherein said first retention pin and said second retention pin are attached to said bridge section.

18. A fuel injector retention arrangement as in claim 15 wherein each of said retention arms includes a retention arm catch which protrudes from said retention arm toward said fuel rail socket.

19. A fuel injector retention arrangement as in claim 1 wherein said first retention pin and said second retention pin are joined together by a retention pin link that is integrally formed with said first retention pin and said second retention pin.

20. A fuel injector retention arrangement as in claim 19 wherein:

said retention pin retaining member is a retention latch fixed to said fuel injector; and said retention latch is snapped over said retention pin link, thereby retaining said first retention pin and said second retention pin.

21. A fuel injector retention arrangement as in claim 19 wherein said retention pin link comprises:

a retention pin link first leg extending from said first retention pin in a direction that is substantially perpendicular to said first retention pin;

a retention pin link second leg extending from said second retention pin in a direction that is substantially perpendicular to said second retention pin; and a retention pin link bridge which joins said retention pin link first leg and said retention pin link second leg.

22. A fuel injector retention arrangement as in claim 21 wherein:

said retention pin link first leg is substantially parallel to said fuel rail socket axis; and said retention pin link second leg is substantially parallel to said fuel rail socket axis.

* * * * *